United States Patent [19]

Jaworowsky

[11] Patent Number: 4,580,629

[45] Date of Patent: Apr. 8, 1986

[54] METHOD AND APPARATUS FOR WATER FLOW STIMULATION IN A WELL

[76] Inventor: Igor Jaworowsky, P.O. Box 157, Branchville, N.J. 07826

[21] Appl. No.: 706,951

[22] Filed: Feb. 28, 1985

Related U.S. Application Data

[62] Division of Ser. No. 565,855, Dec. 27, 1984, Pat. No. 4,534,413.

[51] Int. Cl.[4] ..... E21B 33/03; E21B 33/047

[52] U.S. Cl. ..... 166/90; 166/97; 166/302; 166/308

[58] Field of Search ..... 166/302, 308, 379, 86, 166/88, 92, 93, 94, 97, 90

[56] References Cited

U.S. PATENT DOCUMENTS

| | | | |
|---|---|---|---|
| 1,431,779 | 10/1922 | Conrader | 166/86 X |
| 1,857,101 | 5/1932 | Nixon | 166/88 |
| 2,245,870 | 6/1941 | Norman | 166/86 X |
| 2,689,611 | 9/1954 | Martinson | 166/88 X |
| 2,931,379 | 4/1960 | Haydin | 166/88 |
| 3,095,929 | 7/1963 | McGuire et al. | 166/97 |
| 3,108,636 | 10/1963 | Peterson | 166/308 |
| 3,154,148 | 10/1964 | Peterson | 166/88 |
| 3,393,740 | 7/1968 | Seese et al. | 166/93 X |
| 4,205,722 | 6/1980 | Hamar | 166/88 X |
| 4,250,965 | 2/1981 | Wiseman, Jr. | 166/305 R |

*Primary Examiner*—George A. Suchfield
*Attorney, Agent, or Firm*—David Teschner

[57] ABSTRACT

The invention is directed to the stimulation of water flow into a substantially dry well shaft from adjacent rock and soil strata bearing water supplies by developing passages from such water supplies through the well walls. Liquid or gaseous nitrogen and liquid or gaseous carbon dioxide are introduced into the well either individually or in combination and alternately pressurized and depressurized to cause the rock structure between said well wall and said water supplies to be exposed to high pressures and fractured to thereby open a passage from said water supplies to said well. A well cap is provided to seal the well and retain the pressure developed therein while providing for the introduction of the required materials. Means are also provided to release the pressure in the well quickly to return same to its unpressurized condition.

8 Claims, 9 Drawing Figures

FIG. 6
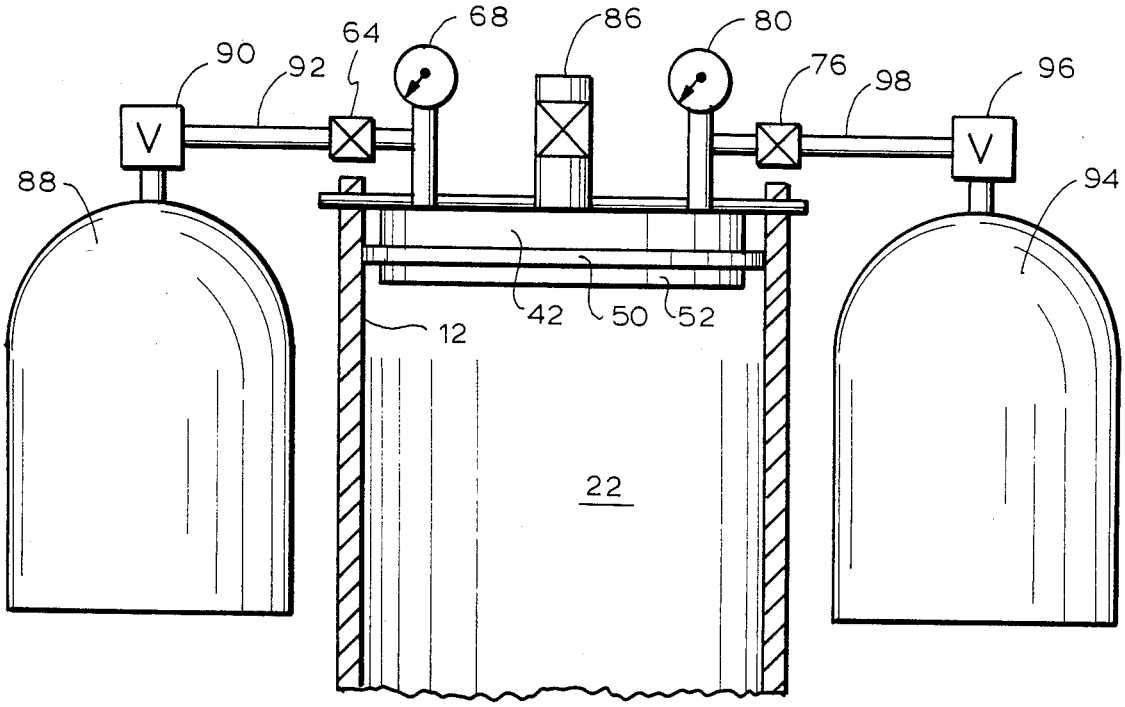
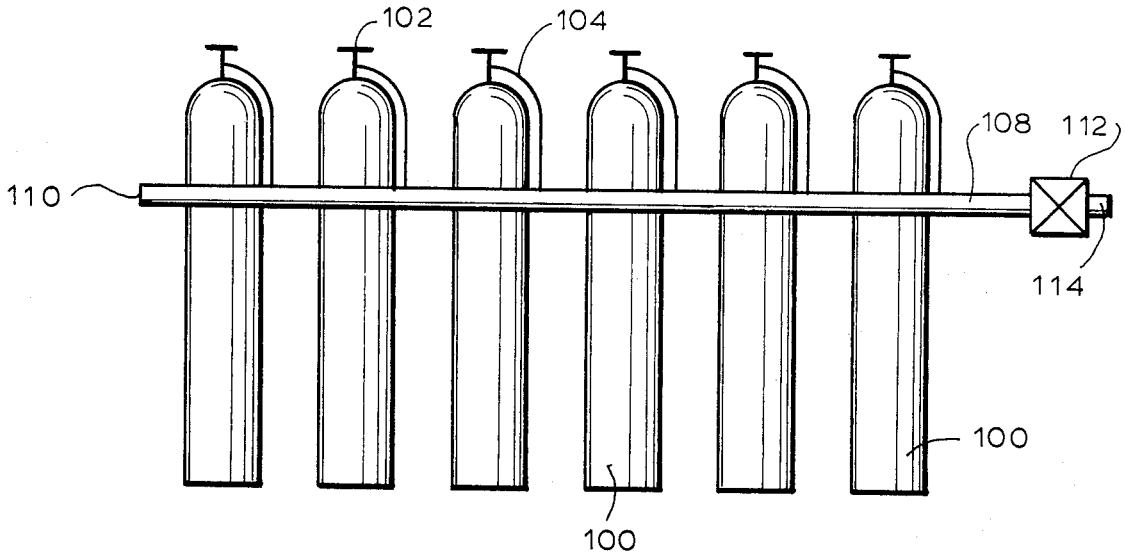
FIG. 7

METHOD AND APPARATUS FOR WATER FLOW STIMULATION IN A WELL

CROSS REFERENCE TO RELATED APPLICATION

This Application is a division of application Ser. No. 565,855 filed Dec. 27, 1984 by Igor Jaworowsky now U.S. Pat. No. 4,534,413.

BACKGROUND OF THE INVENTION

1. Field of the Invention

The invention is directed to the field of water wells and more particularly to the stimulation of water flow into a well from water supplies in the strata about the well by the development of passages in sub strata from said water supplies to said well.

2. Description of the Prior Art

The prior art techniques for stimulating the flow of water in a dry well or one providing insufficient water often involved drilling the well deeper, drilling shafts transverse to the main well shaft or dynamiting the well in the hope of creating fissures in the strata to provide passages to water supplies. Dynamiting more often than not will destroy the well. Other prior art techniques employed treating agents pumped into the well such as inorganic acids, for example hydrochloric acid, sulfuric acid, nitric acid and hydrofluoric acid, some organic acids forming water soluble salts, for example oxalic acid and acetic acid. Solvents, especially organic solvents, for instance alcohols, hydrocarbons and chlorinated hydrocarbons are also useful as are oxidizing agents such as potassium permangenate, hydrogen peroxide, oxygen and substances yielding oxygen. These techniques are extremely useful in the rehabilitation of oil or gas wells but are not directly useful where potable water is required, since these materials act as water polutants which must be removed or treated before the water from the well can be used.

SUMMARY OF THE INVENTION

The embodiments disclosed herein provide a relatively simple, direct manner of stimulating the flow of water from water supplies trapped in the strata about a well shaft into such shaft without adversely affecting the potability of the water released. A strong cap is fitted to the well casing to prevent its unwanted removal therefrom and to provide a seal therebetween so that the pressure on the well can be maintained. The cap is provided with fittings to control the introduction of liquid or gaseous nitrogen and liquid or gaseous carbon dioxide into the well and to control the pressure of the gases produced when the liquids go into their gaseous states. The well pressure control also permits the well gas pressure to be reduced to atmospheric pressure as desired. The liquid or gaseous nitrogen and liquid or gaseous carbon dioxide can be introduced into the well individually or jointly. The liquid nitrogen and liquid carbon dioxide are introduced into the well and upon evaporation lower the temperature of the surrounding strata, by absorbing heat therefrom, to a temperature below the freezing point of water thereby freezing the water present in the strata and causing fractures. The liquids are introduced into the well and the resulting gases are retained under desired pressure levels causing the gases to freeze water or water impregnated soil, sand or rock and thereby expand and fracture. The subsequent release of the well pressure causes melting and further fracturing allowing water to pass into the well under its own pressure. The procedure can be repeated a plurality of times until the flow of water into the well is sufficient. It is therefore an object of this invention to provide a novel method of stimulating water flow into a dry water well or one with low water flow into it.

It is an object of this invention to provide a novel well cap useful in practicing the method of this invention.

It is another object of this invention to provide a novel method of stimulating water flow into a water well without affecting the quality of the water.

It is another object of this invention to provide a novel method of stimulating water flow into a water well employing liquid or gaseous carbon dioxide.

It is still another object of this invention to provide a novel method of stimulating water flow into a water well employing liquid or gaseous nitrogen.

It is yet another object of this invention to provide a novel method of stimulating water flow into a water well employing both liquid or gaseous carbon dioxide and liquid or gaseous nigrogen alternately.

It is yet another object of this invention to provide a novel method of stimulating water flow into a water well employing both liquid or gaseous carbon dioxide and liquid or gaseous nitrogen simultaneously.

It is still another object of this invention to provide a novel well cap which comprises fittings for admitting liquid or gaseous carbon dioxide and liquid or gaseous nitrogen into a well over which it is placed.

It is yet another object of this invention to provide a novel well cap which comprises means to mount such cap upon a well head and seal the interface between said cap and said well head.

It is yet another object of this invention to provide a novel well cap which comprises means to mount such cap upon a well head and seal the interface between said cap and said well, provide fittings to introduce liquid carbon dioxide and liquid nitrogen into said well and pressure relief means to decrease the pressure in said well to a desired level.

Other objects and features of the invention will be pointed out in the following description and claims and illustrated in the accompanying drawings, which disclose, by way of example, the principles of the invention, and the best modes which have been contemplated for carrying them out.

BRIEF DESCRIPTION OF THE DRAWINGS

In the drawings in which similar elements are given similar reference characters:

FIG. 6 is a side elevational view of the well cap of FIG. 5 with cryogenic tanks for liquid nitrogen and liquid carbon dioxide attached.

FIG. 7 is a schematic side elevational view of a series of high pressure tanks attached to manifold and which can be used to provide liquid carbon dioxide or liquid nitrogen to the well cap.

DESCRIPTION OF THE PREFERRED EMBODIMENT

Figure 1:
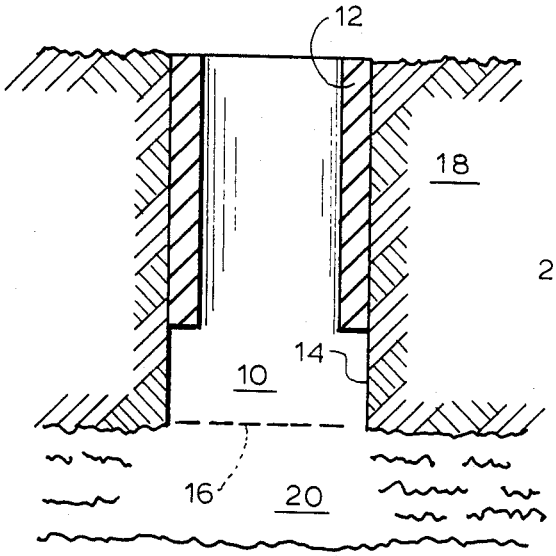
FIG. 1 is fragmentary schematic side elevational view of a first type of water well.

Turning now to FIGS. 1 to 3 and 8 there are shown schematic side elevational views of three generalized types of wells and their surrounding soil, rock and water formations with respect to well casing 12. As the well 10 is drilled, a metal well casing 12 is inserted into at least the upper portion of the well to prevent collapse of the well and the undermining of the adjacent soil. The depth of the casing 12 is selected in accordance with the type of substrate through which the well is being drilled and in accordance with applicable local law. In general, the casing 12 is about 50 feet in a domestic water well. If desirable or necessary, the walls of the lower part of the well may be partially cemented, bricked etc. Water enters the well 10 through the side walls 14 or the open bottom 16, presuming the side walls 14 and the bottom 16 are porous enough to permit the passage of water therethrough and into the well 10. FIG. 1 shows the ideal type of arrangement wherein well 10 is sunk through a rock and soil strata 18 to emerge into a aquifer of water 20 such as an underground spring. Such a well 10 could easily be expected to provide a continuous supply of water at the rate of about 1 to 5 gallons per minute. If sufficient hydrostatic pressure or head is not present to force the water out of well 10 to its desired location a submersible pump (not shown) of the type well known in the art can be used to pump the water from well 10.

Figure 2:
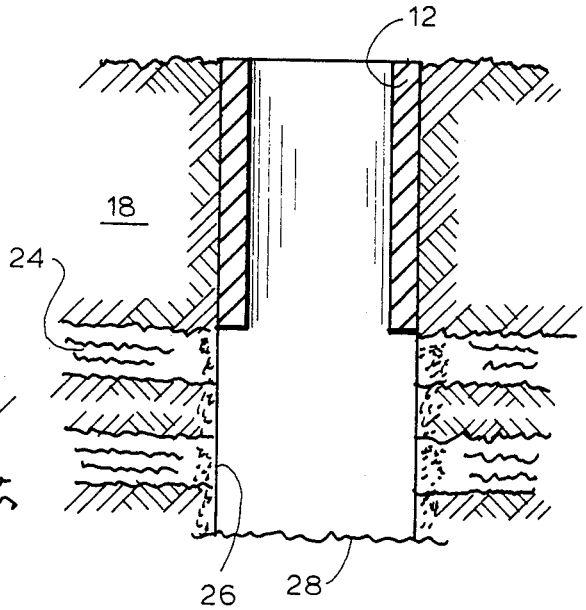
FIG. 2 is a fragmentary schematic side elevational view of a second type of water well.

FIG. 2 illustrates a well 22 drilled through a rock and soil strata 18 into a water bearing sand aquifer 24. Water is able to pass through the side walls 26 and bottom 28 into the interior of well 22 at a rather slow rate such that only about 0.5 to 0.3 gallons per minute can be delivered from such a well. However, upon aging the water flow rate will be reduced to the range of 0.01 to 0.2 gallons per minute depending upon the quality of the water.

Figure 3:
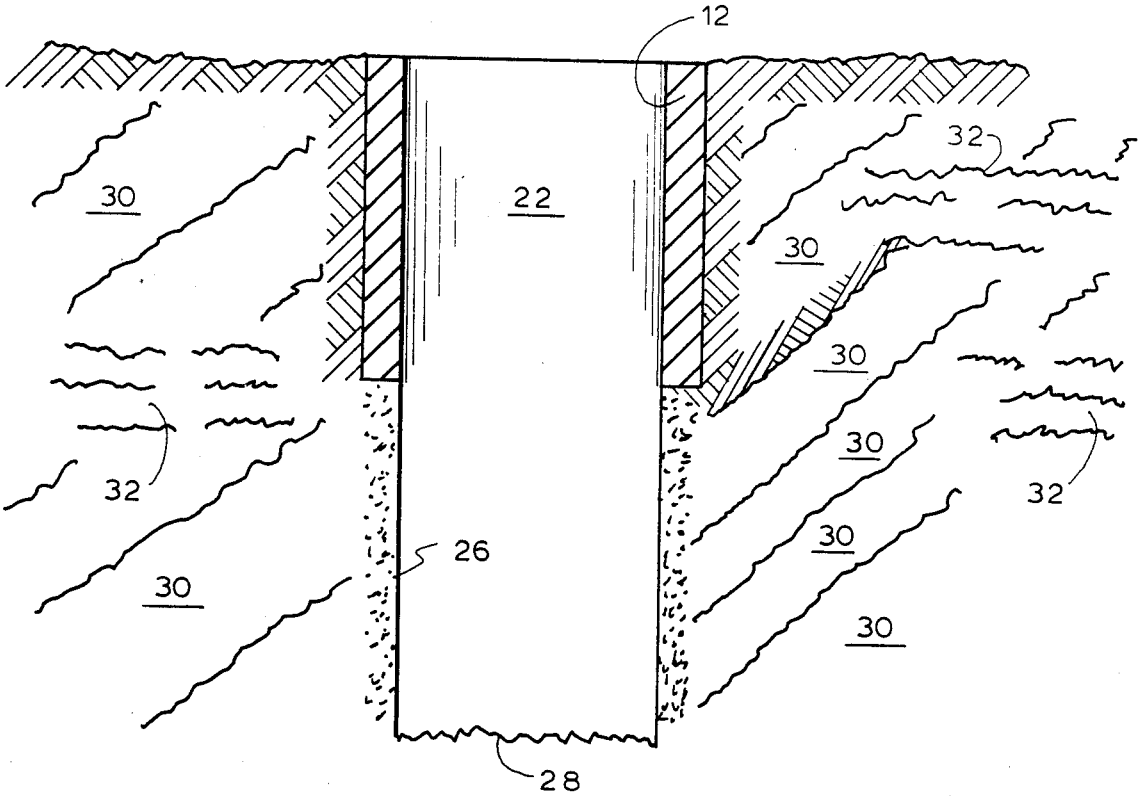
FIG. 3 is a fragmentary side elevational view of a third type of water well.
Figure 8:
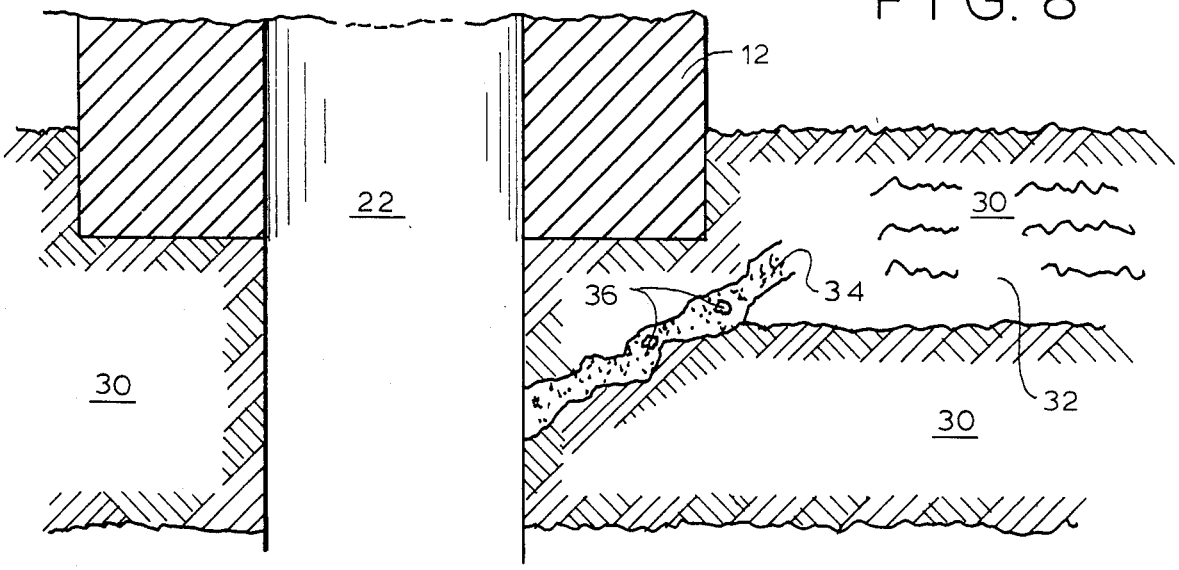
FIG. 8 is a fragmentary side elevational view of a portion of the third well type of FIG. 3 greatly enlarged.

FIGS. 3 and 8 illustrate the more usual type of formations found on the northeast seaboard. A number of stratified layers 30 of rock of different composition are found. Trapped among these rock layers are water aquifers 32 which may be natural wells where water has percolated up from lower levels and various well known types of aquifers. The interfaces between these layers 30 may provide passages for the trapped water 32 or the layers themselves may be fractured or contain weakened sections which can be turned into passages 34 (see FIG. 8) to conduct water from the aquifers 32 through the side walls 26 and into the interior of the well 22. Wells in this type of formations may provide for a flow of from 1 to 5 gallons per minute and are also subject to a decreased flow rate due to aging of the well or clogging. However, to insure a smooth continuous fow of water from the aquifer 32 to the interior of the well 22 it is necessary that the natural passages such as 34 be enlarged and cleared of any fragmented rock, such as 36 (see FIG. 8) loose soil, sand or similar materials which prevent or restrict the flow of water into well 22.

Figure 4:
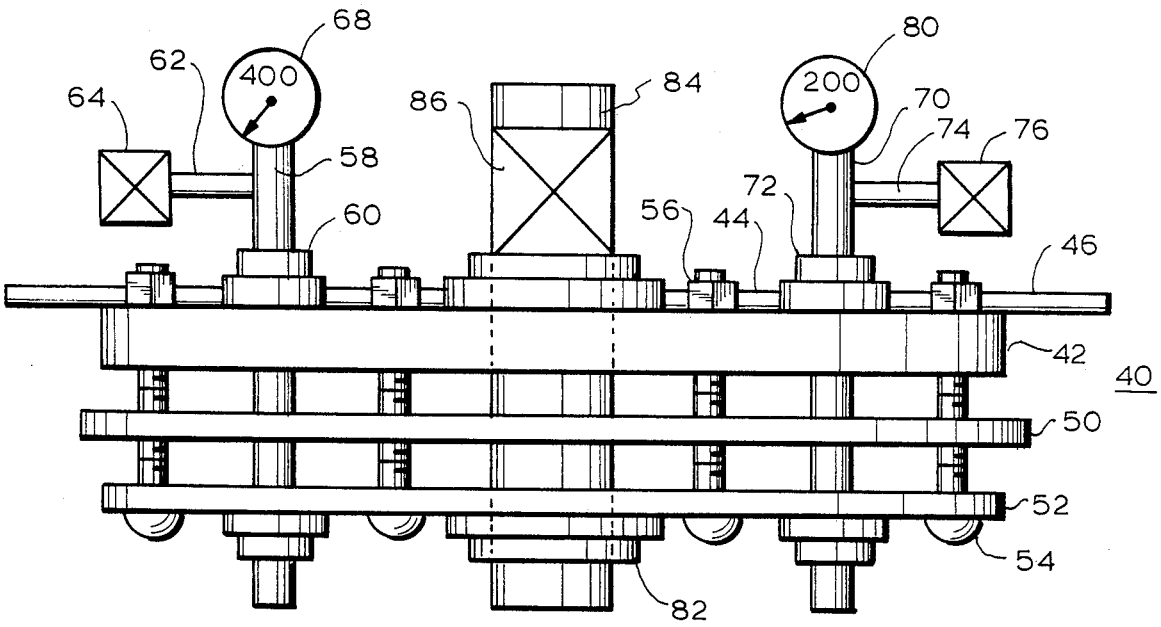
FIG. 4 is a side elevational view of a well cap constructed in accordance with the concepts of the invention in its open condition.
Figure 5:
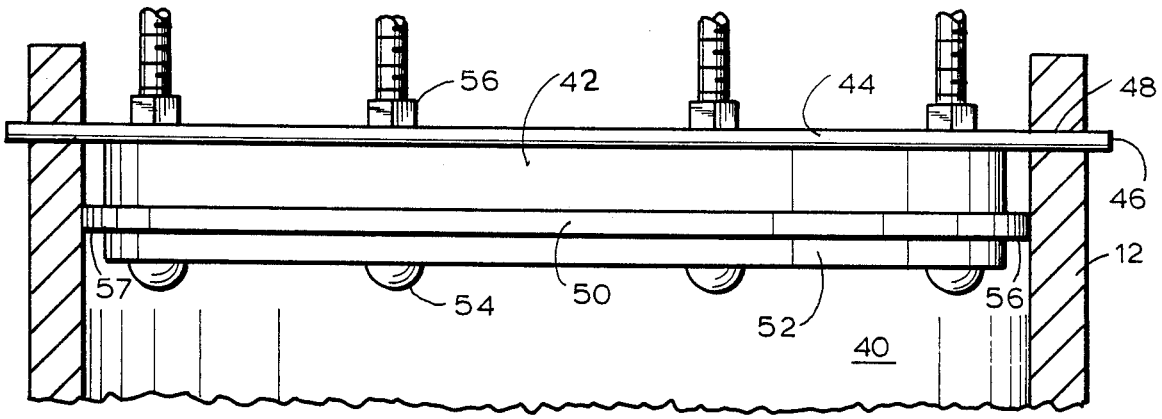
FIG. 5 is a side elevational view of the well cap of FIG. 4 in its closed condition in position at a well head and with certain of the fittings removed for the sake of clarity.

Referring now to FIGS. 4 and 5, a well cap 40 constructed in accordance with the conepts of the invention is shown. Well cap 40 is used to introduce the various materials into the well 22 as well as to control the pressure within the well 22. Well cap 40 is fabricated of a round upper steel plate 42 which may be approximately 1 inch thick. Two $\frac{1}{2}$ inch steel pins 44 (see FIG. 5), the ends 46 of which fit into receiving apertures 48 in casing 12 retain the well cap 40 at the mouth of the casing 12. Below upper plate 42 is, in order a $\frac{3}{4}$ inch compressible round gasket 50 which may be fabricated from neoprene or a similar flexible, resilient material, and a $\frac{1}{2}$ inch round steel pressure plate 52. A series of $\frac{1}{2}$ inch threaded bolts 54 extend through suitable apertures in plates 52 and 42 and gasket 50 and are received in associated nuts 56. Upon the tightening of nuts 56 upon threaded bolts 54, plate 52 moves towards plate 42 compressing gasket 52 therebetween and causing same to expand beyond the periphery of plates 52 and 42, as at 57 best seen in FIG. 5, to engage the inner surface of well casing 12 and provide a complete seal.

A $\frac{3}{4}$ inch inside diameter nitrogen feed pipe 58 extends through plates 42, 52 and gasket 50 and is supported by appropriate flanges 60 mounted on plates 52 and 42. Pipe 58 has an arm 62 to which a $\frac{3}{4}$ inch ball valve 64, of a type well known in the art, is attached which in turn will be coupled to the high pressure nitrogen feed line 92. The ball valve 64 permits the pressure in pipe 58 to be reduced if it becomes too high as shown by guage 68 coupled to pipe 58. A similar arrangement is shown to permit the introduction of liquid or gaseous carbon dioxide into well 22. A $\frac{1}{2}$ inch inside diameter feed pipe 70 extends through plates 42 and 52 as well as gasket 50 and is supported by suitable flanges 72. Pipe 70 has an arm 74 to which a $\frac{1}{2}$ inch ball valve 76, of a type well known in the art, is attached and which is in turn coupled to the high pressure carbon dioxide feed line 98. The ball valve 76 permits the pressure in pipe 70 to be reduced if it becomes too high as shown by gauge 80 coupled to pipe 70. Finally a 2 inch pipe flange 82 supports a stub pipe 84 which passes through plates 42, 52 and gasket 50 and supports a 2 inch ball valve 86, of a type well known in the art, which controls the overall pressure in well 22 and permits the quick reduction of the pressure in the well of 160 to 400 psi, to atmospheric pressure of 14.7 psi.

Turning now to FIGS. 6 and 7 the manner of supplying the liquid gasses are shown. The liquid nitrogen is maintained in a cryogenic tank 88, one such tank is sold by MVE Cryogenics, type No. UGL-160L and the liquid or gaseous nitrogen is released by opening valve 90 into high pressure hose 92 insulated with armflex insulation to prevent freezing, (one such hose is manufactured by Western Industries in stainless steel or braided metal, another by Goodyear Tire and Rubber Company of double steel braided nitrite) to the ball valve 64 to FIG. 6. The liquid carbon dioxide is fed from cryogenic tank 94 via valve 92, high pressure hose 98 also insulated with armflex to ball valve 76. Alternatively, the liquid or gaseous nitrogen and liquid or gaseous carbon dioxide may be provided by a series of cylinders. Cylinders of the type required are manufactured by Norris Industries, Model No. 3AA205. A number of nitrogen cylinders 100 are shown in FIG. 7. The number of cylinders 100 employed depends on the total volume of gas required by the well. Each liquid cylinder 100 is fitted with a dip tube and is piped by means of ½ inch high pressure insulated hose 104 to a 1 inch manifold 108. Manifold 108 is plugged at one end by a suitable plug 110 and the free end extends to a suitable 1 inch ball valve 112, and through a further high pressure insulated hose 114 to the ball valve 64. The ball valves 64, 76 and 86 are of the full port type manufactured, for example, by DYNA QUIP type No. VPE2AO.

The overall operation of the system can now be set forth. The well cap 40 is placed on the well casing 12 and the steel pins 44 are positioned atop plate 42 with the ends 46 extending into the apertures 48 in the well casing 12. The nuts 56 are tightened upon threaded bolts 54 such that is periphery 57 expands to engage the inner surface of the well casing 12. Assuming a cryogenic tank 88 of liquid nitrogen is to be employed, (the procedure will be similar for gasses contained in cylinders 100) valve 90 is opened to admit liquid nitrogen through ball valve 64, arm 62 and pipe 58 into the well 22. The liquid nitrogen will force any water in the well 22 bottom into the passages 34 and will freeze such water as well as any water present in the passages 34 and some of the water in the water pools 32. As the freezing takes place the water expands and causes the cracking of the materials in the passages 34 as well as the materials adjacent the passage 34. The pressure of the nitrogen is maintained at about 160 to 180 psi. (If gas is used, it will pressurize the formations and cause cracking of the strate.) After a sufficient time has elapsed, approximately 20 minutes, the pressure in the well 22 is reduced to atmospheric pressure by opening ball valve 86. The rapid drop in pressure changes the liquid nitrogen to gaseous form causing the water in the well and in the strata to rapidly freeze and creating fractures in the strata. This treatment may be repeated as many times as required. The gas also propels the material 36 in passages 34 and increasing the flow of water from water pools 32 into the well 22.

Figure 9:
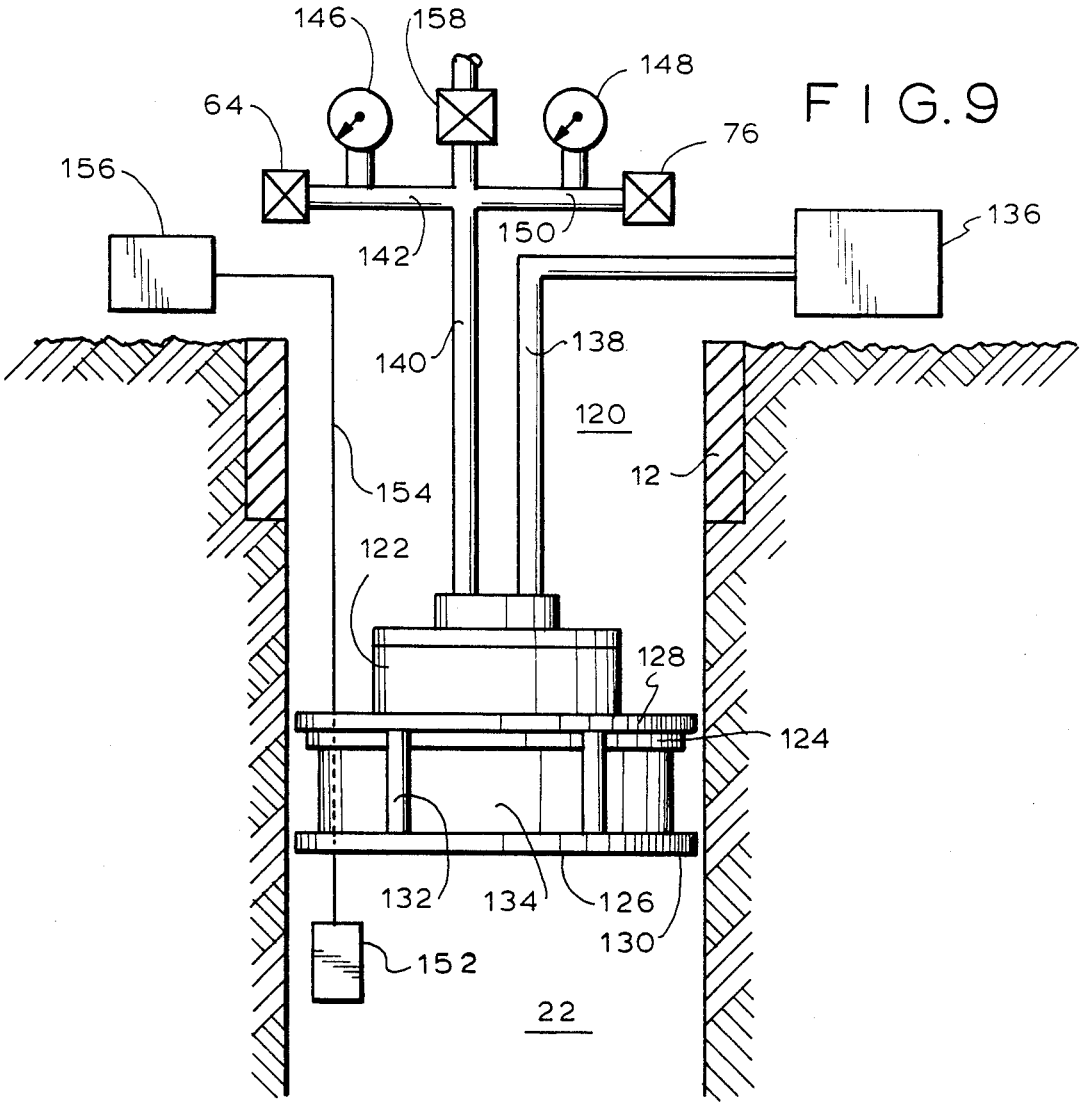
FIG. 9 is a side elevational view of an alternate form of well cap constructed in accordance with the concepts of the invention installed within a well.

Turning now to FIG. 9 an alternative form of well cap 120 is shown. Whereas well cap 40 is well suited for use at the upper end of well casing 12, only well cap 120 may be used down in the well shaft as well. The central element of well cap 120 is a hydraulic cylinder 122 having a piston or plunger 124 with a central passage 126 there through. An upper pressure plate 128 is fixed to the lower end of the casing of hydraulic cylinder 122. A second pressure plate 130 is fixedly coupled to pressure plate 128 by means of 4 solid steel rods 132. A suitable hydraulic cylinder is manufactured by Hydraulic System Enerpac, Division of Applied Power Inc. Model RCH306 is a 30 ton single acting hydraulic cylinder with a hollow plunger having a 6 inch stroke.

Mounted between pressure plates 128 and 130 is a neoprene gasket 134 which is approximately the same width as the plates 128 and 130 and approximately five and one half inches thick. When acted upon by piston or plunger 124, neoprene gasket 134 trapped between plunger 124 and lower pressure plate 130 is caused to expand outwardly and grip the walls of well 22. The engagement between the periphery of the neoprene gasket 134 and the walls of well 22 serves to hold the position of cap 120 at the desired depth in the well 22 and to seal the well 22 at such depth. In this manner, the volumes of liquid or gaseous nitrogen or carbon dioxide can be greatly reduced when compared to the volume required when well cap 40 is employed. Also due to the decreased volume, the pressure in the well 22 can be greatly increased. Liquid or gaseous nitrogen and liquid or gaseous carbon dioxide can be placed in the well 22 through a high pressure hose 140 which passes into the central passage 126 in plunger 124. A high pressure hose 138 leads from hydraulic pump 136 to hydraulic cylinder 122 to compress the neoprene gasket 134. The liquid or gaseous nitrogen is supplied via high pressure line 92 to ball valve 64, pressure gauge 146 (4000 psi gauge although the pressure used is about 2000 psi) line 142 to high pressure hose 140. Similarly liquid or gaseous carbon dioxide is fed via high pressure hose 98, ball valve 76, gauge 148, line 150 to high pressure hose 140 as generally described above. Also the well pressure can be relieved via ball valve 158.

A probe 152 is lowered into well 22 to measure the static head and the rate of flow of water into the well 22. It may be necessary to pump all water out of the well 22 so that an accurate measurement of the water inflow into the well 22 can be made. Suitable probes are made by Amatrex Well Controls under the name Pressure Transmitter for Wells or Well Probe by Actal, Bellingham, W. Va. Probe 152 is coupled to a suitable indicator 156 by means of a cable 154.

Using well cap 120, it is possible to alternately pressurize-depressurize the well 22 and make measurements without altering the position of well cap 120 or disconnecting the liquid or gas tanks and associated hose, gauges etc.

It has been found that the liquid carbon dioxide, although not as cold as the liquid nitrogen, seems to give a somewhat better scouring action. Accordingly, after a few cycles of liquid or gaseous nitrogen introduction and release, liquid or gaseous carbon dioxide is introduced. The liquid carbon dioxide is cryogenic tank 94 is releaed by opening valve 96 to pass by means of insulated hose 98 to ball valve 76, arm 74, pipe 70 into well 22. The liquid carbon dioxide extends into well 22. The liquid carbon dioxide extends into many crevaces, open seams, rock fissures and freezes the water within causing the further cracking of soil, sand, rock formations or other materials encountered. If desired both carbon dioxide and nitrogen liquids or gases can be admitted to the well 22 at the same time. When there is sufficient water in the well 22, the ability of the water to be removed from well 22 will depend upon the natural static head or pressure on the water. If necessary a submersible pump may be placed down into the well 22 to pump water from it.

The number of cycles of pressurizing and depressurizing and the use of liquid or gaseous nitrogen or liquid or gaseous carbon dioxide individually or in combination will depend upon the porosity of the materials surrounding the well 22, the structure of the strata and the response of the strata to the freezing - unfreezing cycle, high pressure-low pressure cycle.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A well cap for sealing a well and permitting the pressurization of the contents of said well comprising: plate means proportioned to be received in a well casing: sealing means for sealing the periphery of said well cap extendable beyond said periphery of said well cap into engagement with said well casing to seal the interspace between said periphery and said well casing; at least one fitting for admitting a liquified or non-liquified gas into said well and pressure release means extending through said plate means and said seal means for rapidly decreasing the pressure in said well to atmospheric pressure.

2. A well cap as defined in claim 1, further comprising a pressure plate movable coupled to said plate means and said seal means comprising a deformable gasket deformed into engagement with said well casing as said pressure plate is moved toward said plate means.

3. A well cap as defined in claim 1, wherein two fittings for admitting liquified or non-liquified gasses into said well are provided each fitting extending through said plate means and said seal means.

4. A well cap as defined in claim 1, further comprising locking means for engaging said casing to maintain the position of said cap.

5. A well cap for sealing a well and permitting the pressurization of the contents of said well comprising; plate means proportioned to be received in a well casing; seal means for sealing the periphery of said well cap; two fittings for admitting liquified or non-liquified gasses into said well liquified nitrogen in a cryogenic tank is coupled to a first of said two fittings and liquid carbon dioxide in a cryogenic tank is coupled to the second of said fittings and presure release means for rapidly decreasing the pressure in said well to atmospheric pressure.

6. A well cap for sealing a well and permitting the pressurization of the contents of said well comprising: plate means proportioned to be received in a well casing: seal means for sealing the periphery of said well cap; two fittings for admitting liquified or non-liquidfied gasses into said well liquified or gaseous nitorgen in a series of cylinders coupled to a first of said two fittings and liquified or gaseous carbon dioxide in a series of cylinders coupled to a second common manifold is coupled to the second of said two fittings and pressure release means for rapidly decreasing the pressure in said well to atmospheric pressure.

7. A well cap for sealing a well and permitting the pressurization of the contents of said well comprising; plate means proportioned to be received in a well casing; seal means for sealing the periphery of said well cap; at least one fitting for admitting a liquified or non-liquified gas into said well; pressure release means for rapidly decreasing the pressure in said well to atmosheric pressure; a hydraulic cylinder having a plunger with a passage therethrough, said plate means coupled to said cylinder for movement therewith; and further plate means fixedly coupled to said cylinder; said seal means positioned between said plate means and said further plate means.

8. A well cap as defined in claim 7, wherein said seal means is a deformable gasket deformed into engagement with the walls of a well as said plunger is advanced towards said further plate means by said hydraulic cylinder.

* * * * *

UNITED STATES PATENT AND TRADEMARK OFFICE

CERTIFICATE OF CORRECTION

PATENT NO. : 4,580,629

DATED : April 8, 1986

INVENTOR(S) : Igor Jaworowsky

It is certified that error appears in the above—identified patent and that said Letters Patent is hereby corrected as shown below:

Column 5, line 32, "strate" should be--strata--

Column 6, line 37, "releaed" should be--released--

Claim 2, line 2, "movable" should be--movably--

Signed and Sealed this

*Twenty-ninth* Day of *July 1986*

[SEAL]

*Attest:*

DONALD J. QUIGG

*Attesting Officer*

*Commissioner of Patents and Trademarks*